US007712465B2

(12) United States Patent
Carnall et al.

(10) Patent No.: US 7,712,465 B2
(45) Date of Patent: May 11, 2010

(54) VALVE FOR GAS OPERATED GUN

(75) Inventors: Martin Carnall, Leicester (GB); Paul Garry, Middleton (GB)

(73) Assignee: Black Market Sportz Limited (GB)

( * ) Notice: Subject to any disclaimer, the term of this patent is extended or adjusted under 35 U.S.C. 154(b) by 739 days.

(21) Appl. No.: 11/570,723

(22) PCT Filed: Jun. 15, 2005

(86) PCT No.: PCT/GB2005/002378

§ 371 (c)(1),
(2), (4) Date: Mar. 2, 2007

(87) PCT Pub. No.: WO2005/124264

PCT Pub. Date: Dec. 29, 2005

(65) Prior Publication Data

US 2007/0295320 A1 Dec. 27, 2007

(30) Foreign Application Priority Data

Jun. 15, 2004 (GB) ..... 0413326.0

(51) Int. Cl.
*F41B 11/00* (2006.01)

(52) U.S. Cl. ..... 124/75; 124/73; 124/76; 124/77

(58) Field of Classification Search ..... 124/73–77
See application file for complete search history.

(56) References Cited

U.S. PATENT DOCUMENTS 2,925,965 A * 2/1960 Pierce ..... 89/135
3,153,367 A * 10/1964 Ross et al. ..... 89/1.1
3,565,009 A * 2/1971 Allred et al. ..... 102/475
3,703,865 A * 11/1972 Gilbertson et al. ..... 102/475
3,796,158 A * 3/1974 Conger ..... 102/492
3,796,159 A * 3/1974 Conger ..... 102/492
3,960,085 A * 6/1976 Abernathy et al. ..... 102/492
4,026,213 A * 5/1977 Kempton ..... 102/475
4,658,727 A * 4/1987 Wilhelm et al. ..... 102/494
4,662,281 A * 5/1987 Wilhelm et al. ..... 102/494
4,848,239 A * 7/1989 Wilhelm ..... 102/492
5,050,503 A * 9/1991 Menz et al. ..... 102/475
5,182,418 A * 1/1993 Talley ..... 102/475
5,544,589 A * 8/1996 Held ..... 102/492

(Continued)

FOREIGN PATENT DOCUMENTS

FR 2425894 A 12/1979

(Continued)

OTHER PUBLICATIONS

International Search Report for PCT/GB2005/002378 mailed on Sep. 16, 2005.

*Primary Examiner*—Troy Chambers
(74) *Attorney, Agent, or Firm*—Caesar, Rivise, Bernstein, Cohen & Pokotilow, Ltd.

(57) ABSTRACT

In a paintball gun 10 the valve member 17 which controls communication between the gas canister 13 and the barrel 11 of the gun is balanced by a piston 23. When the chamber 21 is pressurized the piston 23 helps to unseat the valve member 17 when the latter is struck by a hammer 15, thus reducing recoil and permitting use of lighter, less robust materials.

14 Claims, 2 Drawing Sheets

U.S. PATENT DOCUMENTS

| | | | | |
|---|---|---|---|---|
| 6,003,504 | A * | 12/1999 | Rice et al. | 124/73 |
| 6,349,711 | B1 * | 2/2002 | Perry et al. | 124/73 |
| 6,820,606 | B1 * | 11/2004 | Duffey | 124/31 |
| 6,832,605 | B2 * | 12/2004 | Farrell | 124/76 |
| 7,150,276 | B1 * | 12/2006 | Rice | 124/73 |
| 2003/0000511 | A1 * | 1/2003 | Moritz | 124/73 |
| 2003/0019386 | A1 * | 1/2003 | Lloyd et al. | 102/494 |
| 2006/0037597 | A1 * | 2/2006 | Wood | 124/73 |
| 2007/0277798 | A1 * | 12/2007 | Bhogal | 124/74 |

FOREIGN PATENT DOCUMENTS

| | | | |
|---|---|---|---|
| GB | 2350667 | A | 12/2000 |
| GB | 2372552 | A | 8/2002 |
| WO | 01/36894 | A2 | 5/2001 |

* cited by examiner

VALVE FOR GAS OPERATED GUN

BACKGROUND OF THE INVENTION

This invention relates to a valve for a gas operated gun, particularly although not exclusively a paintball gun. Paintball guns are used to fire balls or pellets of paint at other players of military games to mark them as "hit".

In one form of paintball gun compressed gas is released to fire a paint pellet when a valve controlling the gas pathway is struck by a hammer. This rather violent action produces a substantial recoil which can spoil the user's aim and cause discomfort. It also requires the use of relatively heavy and expensive components, such as the hammer, which will be capable of standing up to the wear and tear involved.

A principal object of the present invention is to address this problem.

SUMMARY OF THE INVENTION

In accordance with the present invention there is provided a valve assembly for a gas operated gun of the kind having a barrel, a trigger, a chamber having an inlet in communication with a source of gas under pressure, an outlet communicating with the barrel and a valve member controlling the outlet biased to the closed position but which is unseated when the trigger is pulled to allow pressurised gas to expel a pellet from the barrel, the valve assembly comprising a piston reciprocable in a bore open at one end to said chamber, the piston having a surface area exposed to the interior of the chamber not greater than the surface area of said valve member exposed to the interior of the chamber and a mechanical connection between the piston and the valve member such that pressurised gas in the chamber acting on the piston will have an unseating influence on the valve member.

The said bias of the valve member, which may be provided by a spring, ensures closure of the valve member after the gun has been fired and when there is no substantial gas pressure in the chamber. However with the valve member closed and the chamber pressurised the piston will reduce the force required to unseat the valve member, permitting the use of lighter and cheaper components and avoiding a violent recoil when the gun is fired.

Preferably the valve member and piston are at opposite ends of the chamber, the mechanical connection being a rod extending therebetween. In this case the valve member may be biased to the closed position by a spring in said bore acting on the piston.

The valve member may have on its face exposed from the chamber a projection which is struck by a hammer when the trigger is pulled. Preferably the hammer moves jointly with a bolt reciprocable in the barrel to select a paintball from a magazine thereof above the barrel, and gas under pressure from said outlet of the chamber may pass through the bolt to expel a selected paintball from the barrel.

Preferably the surface area of the piston exposed to the interior of the chamber is less than the surface area of the valve member exposed to the interior of the chamber. The ratio of said surface areas may be in the region of 2:1.

BRIEF DESCRIPTION OF SEVERAL VIEWS OF THE DRAWINGS

A preferred embodiment of the present invention will now be described by way of non-limitative example with reference to the accompanying drawings, in which.

DETAILED DESCRIPTION OF THE PREFERRED EMBODIMENTS

Figure 1:
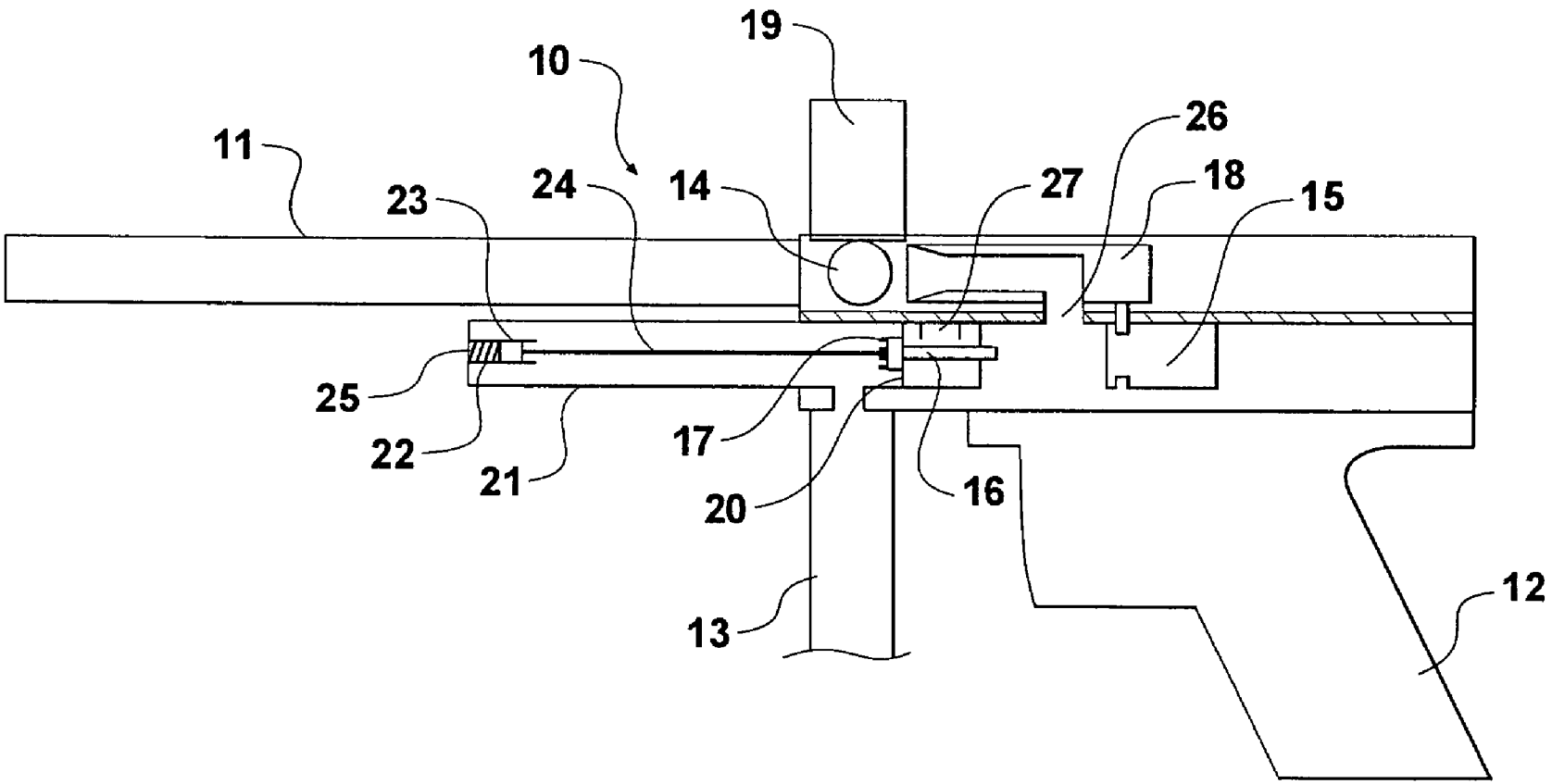
FIG. 1 is a simplified sectional elevation of a paintball gun showing components in an "at rest" position prior to pulling the trigger.
Figure 2:
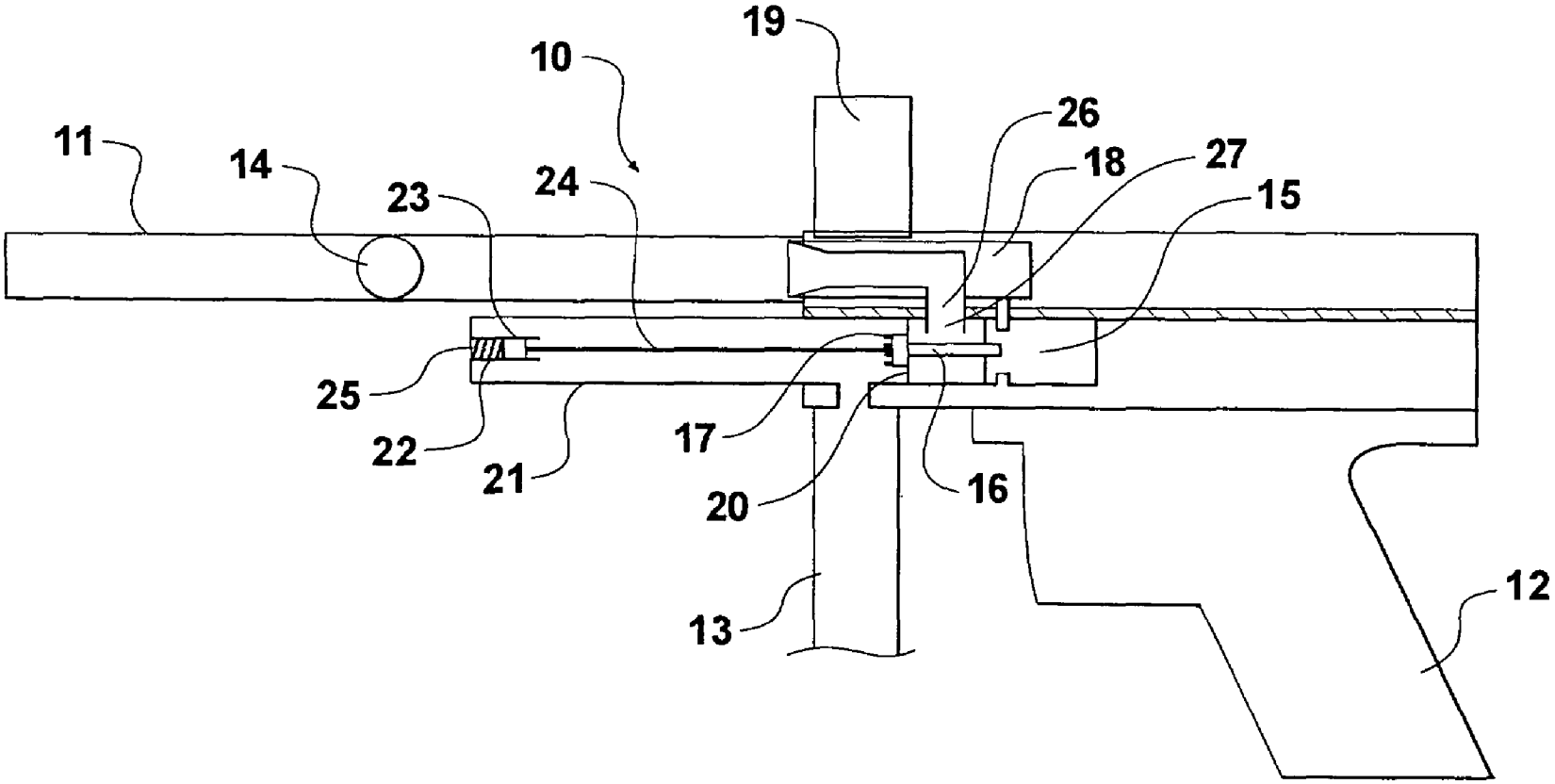
FIG. 2 is a similar view of the same gun showing components in the positions adopted when the trigger of the gun is pulled.

The paintball gun 10 illustrated has a barrel 11 and a grip 12. The grip 12 incorporates a trigger (not shown) which, when pulled, opens communication between a detachable canister 13 of compressed air and the barrel 11 to expel a paint ball or pellet 14 from the latter. When the trigger is pulled a hammer 15 is caused to strike a projection 16 from a valve member 17, unseating the latter so that compressed air can pass from the canister 13 to the barrel 11. The hammer 15 moves jointly with a hollow bolt 18 reciprocable in the barrel 11. A magazine 19 for paint pellets is mounted above the barrel 11 so as to release them one at a time into the barrel. As the bolt 18 moves forward it selects the lowermost paint pellet 14 and moves it forward in the barrel, at the same time closing off the opening at the bottom of the magazine 19. An opening 26 of the bolt lines up with an opening 27 of the chamber 21 so that compressed air from the canister 13 can now blow the selected pellet 14 out of the barrel 11.

As so far described the gun illustrated is conventional. In accordance with the present invention, however, the valve member 17 controls an opening 20 at one end of an elongated chamber 21. At the other end of the chamber 21 is a tube or cylinder 22 in which a piston 23 is reciprocable. The piston 23 is rigidly connected to the valve member 17 by a rod 24. The piston 23 (and therefore the valve member 17) is under the influence of a compression spring 25 located in the tube 22 which, on the side of the piston 23 remote from the chamber 21, opens to atmosphere.

The surface area of the piston 23 exposed to the interior of the chamber 21 is half the surface area of the valve member 17 exposed to the interior of the chamber 21. Thus when the projection 16 of the valve member is struck by the hammer 15 air pressure in the chamber 21 acting on the piston 23 helps to unseat the valve member 17. On the other hand, when the valve member 17 is open there is no excess gas pressure acting on the piston 23 so that even a light compression spring 25 is sufficient to close the valve member 17 when the trigger is released.

Without further elaboration of the foregoing will so fully illustrate our invention that others may, by applying current or future knowledge, adapt the same for use under various conditions of service.

The invention claimed is:

1. A valve assembly for a gas operated gun of the kind having a barrel, a trigger, a chamber having an inlet in communication with a source of gas under pressure, an outlet communicating with the barrel and a valve member having a surface area exposed to the interior of the chamber and controlling the outlet biased to the closed position but which is unseated when the trigger is pulled to allow pressurized gas to expel a pellet from the barrel, wherein the valve assembly comprises a piston reciprocable in a bore open at one end to said chamber, the piston having a surface area exposed to the interior of the chamber not greater than the surface area of said valve member exposed to the interior of the chamber and a mechanical connection between the piston and the valve member such that pressurized gas in the chamber acting on the piston will have an unseating influence on the valve member.

2. A valve assembly as claimed in claim 1, wherein the valve member and piston are at opposite ends of the chamber, the mechanical connection being a rod extending therebetween.

3. A valve assembly as claimed in claim 2, wherein the valve member is biased to the closed position by a spring in said bore acting on the piston.

4. A valve assembly as claimed in claim 1, wherein the valve member has on its face exposed from the chamber a projection which is struck by a hammer when the trigger is pulled.

5. A valve assembly as claimed in claim 4, wherein the hammer moves jointly with a bolt reciprocable in the barrel to select a paintball from a magazine thereof above the barrel, and wherein gas under pressure from said outlet of the chamber passes through the bolt to expel a selected paintball from the barrel.

6. A valve assembly as claimed in claim 1, wherein the surface area of the piston exposed to the interior of the chamber is less than the surface area of the valve member exposed to the interior of the chamber.

7. A valve assembly as claimed in claim 6, wherein the ratio of said surface areas is in the region of 1:2.

8. A valve assembly for a gas operated gun of the kind having a barrel, a trigger, a chamber having an inlet in communication with a source of gas under pressure, an outlet communicating with the barrel and a valve member having a surface area exposed to the gas pressure in the chamber and controlling the outlet biased to the closed position but which is unseated when the trigger is pulled to allow pressurized gas to expel a pellet from the barrel, wherein the valve assembly comprises a piston reciprocable in a bore exposed at one end to the gas pressure in the chamber, the piston having a surface area exposed to gas pressure in the chamber not greater than the surface area of the valve member exposed to the gas pressure in the chamber and a mechanical connection between the piston and the valve member such that pressurized gas in the chamber acting on the piston will have an unseating influence on the valve member.

9. A valve assembly as claimed in claim 8, wherein the valve member and piston are at opposite ends of the chamber, the mechanical connection being a rod extending therebetween.

10. A valve assembly as claimed in claim 9, wherein the valve member is biased to the closed position by a spring in said bore acting on the piston.

11. A valve assembly as claimed in claim 8, wherein the valve member has a projection which is struck by a hammer when the trigger is pulled, thereby unseating the valve member.

12. A valve assembly as claimed in claim 11, wherein the hammer moves jointly with a bolt reciprocable in the barrel to select a paintball from a magazine thereof above the barrel, and wherein gas under pressure from said outlet of the chamber passes through the bolt to expel a selected paintball from the barrel.

13. A valve assembly as claimed in claim 8, wherein the surface area of the piston exposed to the gas pressure in the chamber is less than the surface area of the valve member exposed to the gas pressure in the chamber.

14. A valve assembly as claimed in claim 13, wherein the ratio of the surface areas is in the region of 1:2.

* * * * *